US005931067A

United States Patent [19]

Gold

[11] Patent Number: 5,931,067

[45] Date of Patent: Aug. 3, 1999

[54] SELF ADJUSTING PLIERS

[76] Inventor: Lorne Gold, 3245-28 Ave. S.W., Edmonton, Canada, T6X 1A6

[21] Appl. No.: 08/898,858

[22] Filed: Jul. 25, 1997

[51] Int. Cl.[6] ..... B25B 7/04

[52] U.S. Cl. ..... 81/407; 81/385; 81/342; 81/426.5

[58] Field of Search ..... 81/342, 347, 424, 81/355, 381, 383, 385, 386, 407, 426.5

[56] References Cited

U.S. PATENT DOCUMENTS

| | | | |
|---|---|---|---|
| 120,144 | 10/1871 | Zeiler | 81/342 |
| 685,215 | 10/1901 | Magui | 81/342 |
| 1,337,986 | 4/1920 | Allan | 81/407 |
| 1,805,884 | 5/1931 | Pawsat | 81/426.5 |
| 2,716,365 | 8/1955 | Keeley, Jr. | 81/426.5 |
| 3,142,212 | 7/1964 | Grape | 81/407 |
| 4,662,252 | 5/1987 | Warheit | 81/341 |
| 4,726,265 | 2/1988 | Reich | 81/407 |

*Primary Examiner*—David A. Scherbel
*Assistant Examiner*—Joni B. Danganan
*Attorney, Agent, or Firm*—Anthony R. Lambert

[57] ABSTRACT

A pair of pliers includes a first member and a second member. The first member has a first handle portion, a first jaw portion, and a convex bearing surface portion disposed between the first handle portion and the first jaw portion. The second member has a second handle portion, a second jaw portion and a concave bearing surface portion disposed between the second handle portion and the second jaw portion. The concave bearing surface portion engaging the convex bearing surface portion of the first member to provide a fulcrum point between the first member and the second member. The fulcrum point shifts with relative spacial positioning of the first jaw portion and the second jaw portion.

5 Claims, 3 Drawing Sheets

SELF ADJUSTING PLIERS

FIELD OF THE INVENTION

The present invention relates to self adjusting pliers.

1. Background of the Invention

Pliers are a pincer-like tool in which two jaws and two handles are pivoted to work in opposition. In order to open the jaws, the handles are moved apart. In order to close the jaws, the handles are moved together. When the jaws are at their maximum open position, it can be difficult to squeeze the handles together. The distance between the handles can exceed the grip span of the user. Where the user is at the outer limits of his or her grip span, the gripping pressure which the user is capable of providing is reduced.

To address this problem vice-grip pliers were developed. With vice-grip pliers an adjustment can be made as to the spacing between the jaws, prior to force being applied. Unfortunately, pausing to adjust the spacing between the jaws is time consuming.

2. Summary of the Invention

What is required is pliers that are self adjusting, making them easier and more convenient to use when the jaws approach their maximum open position.

According to the present invention there is provided a pair of pliers which include a first member and a second member. The first member has a first handle portion, a first jaw portion, and a convex bearing surface portion disposed between the first handle portion and the first jaw portion. The second member has a second handle portion, a second jaw portion and a concave bearing surface portion disposed between the second handle portion and the second jaw portion. The concave bearing surface portion engaging the convex bearing surface portion of the first member to provide a fulcrum point between the first member and the second member. The fulcrum point shifts with relative spacial positioning of the first jaw portion and the second jaw portion.

The pliers, as described above, adjusts the fulcrum point according to the size of the object within the jaws. There is no need to stop and adjust for different sizes, the adjustment is made automatically.

Although beneficial results may be obtained through the use of the pliers, as described above, it is preferred that the second member be configured with the second handle portion acting as a lever to increase the mechanical advantage. The second handle portion is pivotally connected to the concave bearing surface portion. The second handle portion has a first end and a second end. A first pivotal connection is provided at the first end pivotally connecting the second handle portion to the first member. A second pivotal connection is provided between the first end and the second end pivotally connecting the second handle portion with the concave bearing surface portion.

Although beneficial results may be obtained through the use of the pliers, as described above, it is preferred that means be provided to maintain the convex bearing surface and the concave bearing surface engaged. Even more beneficial results may, therefore, be provided when the first member has a passage adjacent the convex surface through which the second member extends.

Although beneficial results may be obtained through the use of the pliers, as described above, it is important that the lever be able to withstand the forces acting upon it when the pliers are in use. Even more beneficial results may, therefore, be obtained when the first end of the lever is fork shaped having tines which straddle the first member and concave bearing surface portion of the second member.

BRIEF DESCRIPTION OF THE DRAWINGS

These and other features of the invention will become more apparent form the following description in which reference is made to appended drawings, wherein.

DETAILED DESCRIPTION OF THE PREFERRED EMBODIMENT

Figure 1:
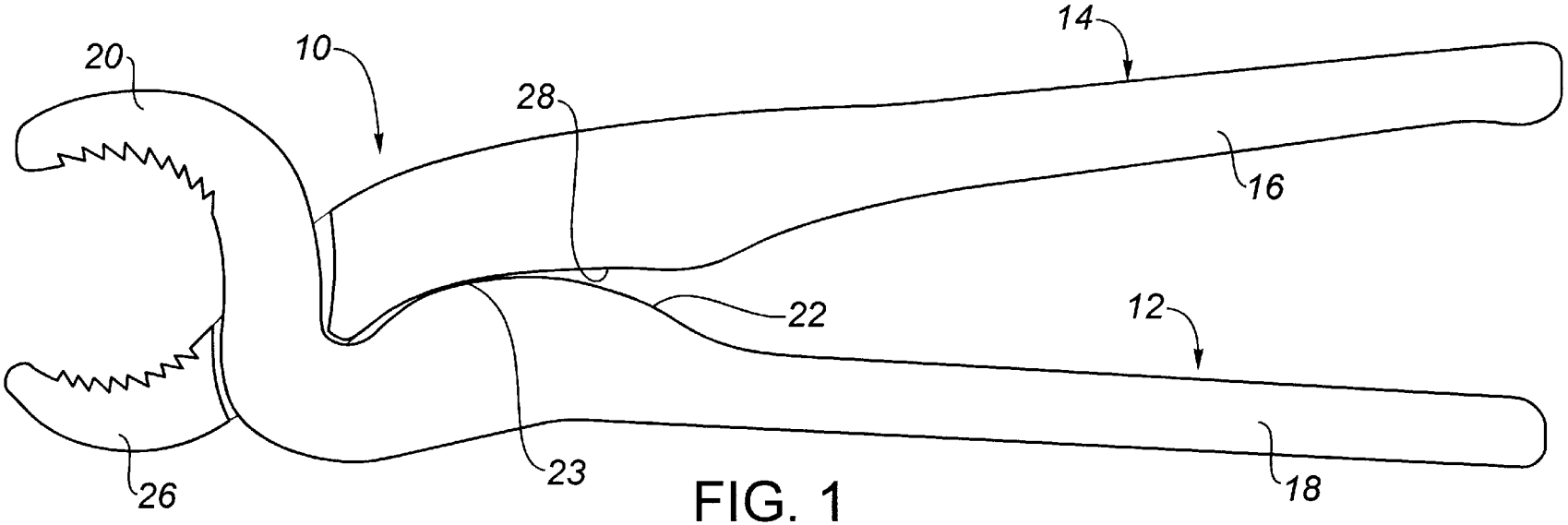
FIG. 1 is a side elevation view, in section, of a first embodiment of pliers constructed in accordance with the teachings of the present invention.

The preferred embodiment, a pair of pliers generally identified by reference numeral 10, will now be described with reference to FIGS. 1 through 5.

Figure 2:
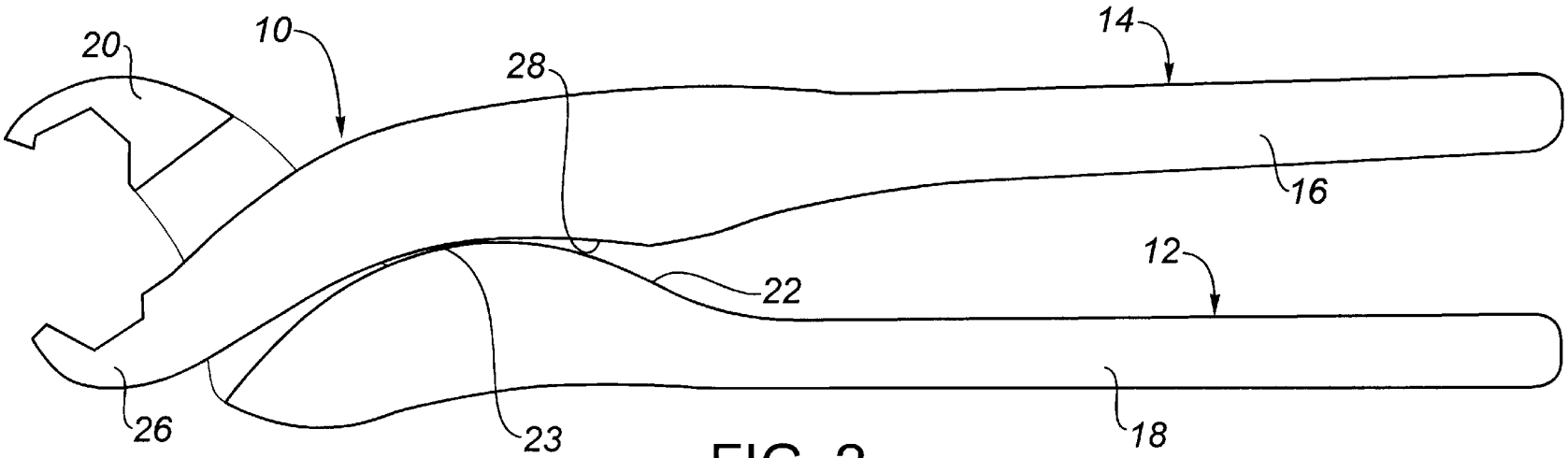
FIG. 2 is a side elevation view, in section, of a second embodiment of pliers constructed in accordance with the teachings of the present invention.

Referring to FIGS. 1 and 2, all embodiments of pliers 10 include a first member 12 and a second member 14. First member 12 has a first handle portion 18, a first jaw portion 20, and a convex bearing surface portion 22 disposed between first handle portion 18 and first jaw portion 20. Second member 14 has a second handle portion 16, a second jaw portion 26 and a concave bearing surface portion 28 disposed between second handle portion 16 and second jaw portion 26.

In operation, concave bearing surface portion 28 engages convex bearing surface portion 22 of first member 12 to provide a fulcrum point 23 between first member 12 and second member 14. Fulcrum point 23 shifts with relative spacial positioning of first jaw portion 20 and second jaw portion 26. In other words, the pliers adjust to suit the size of the object within the jaws. It is to be noted that there is a difference in jaw configuration as between FIG. 1 and FIG. 2. FIG. 1 has a pipe gripping style of jaw. FIG. 2 has a nut engaging form of jaw. This is intended to demonstrate that, merely by changing the jaw configuration, the principle can be applied to a wide variety of tools. The first jaw portion defines in profile a first half of an outer perimeter of a nut. The second jaw portion defines in profile a second half of an outer perimeter of a nut. The first jaw portion and the second jaw portion are brought together to securely engage a nut. Nuts come in a variety of configurations, such as hex nuts, square nuts, etc. Regardless of the configuration a compatible jaw profile can be provided.

Figure 3:
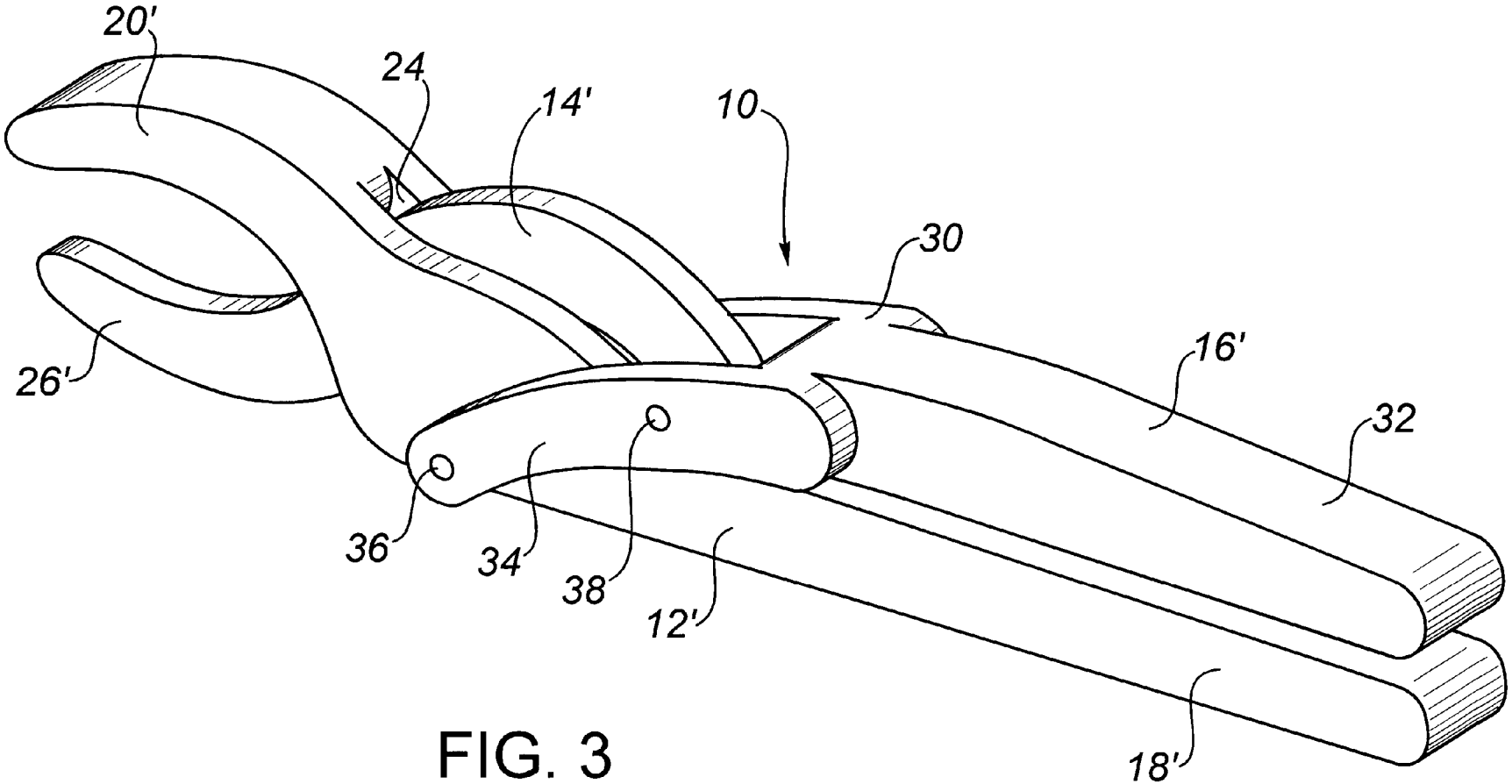
FIG. 3 is a perspective view of a third embodiment of pliers constructed in accordance with the teachings of the present invention.
Figure 4:
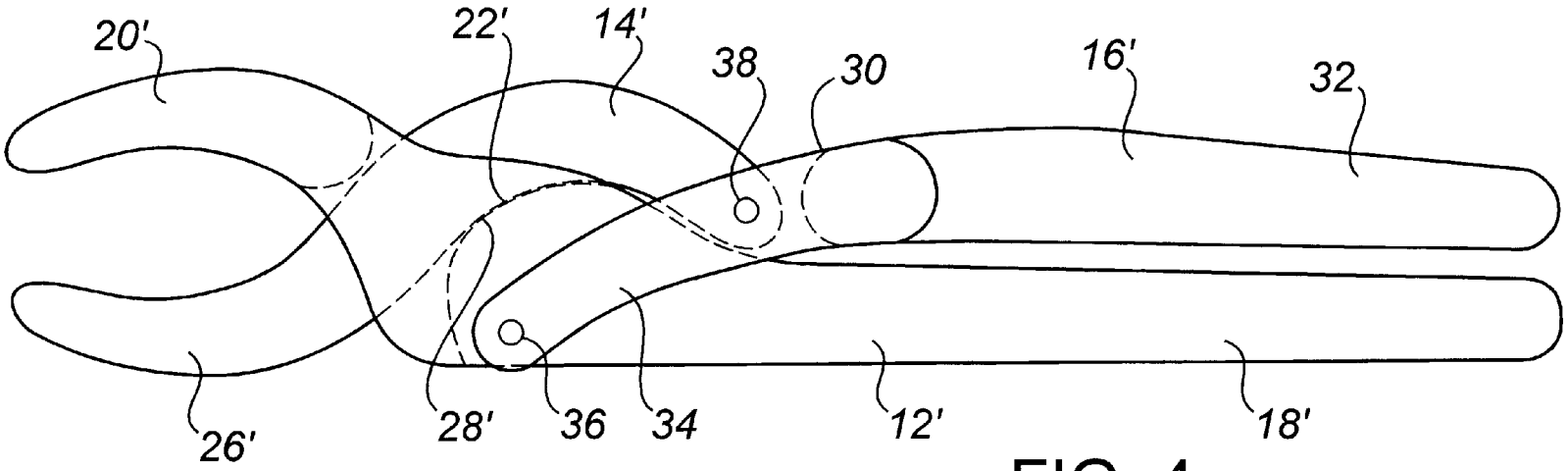
FIG. 4 is a side elevation view, in section, of the pliers illustrated in FIG. 3.
Figure 5:
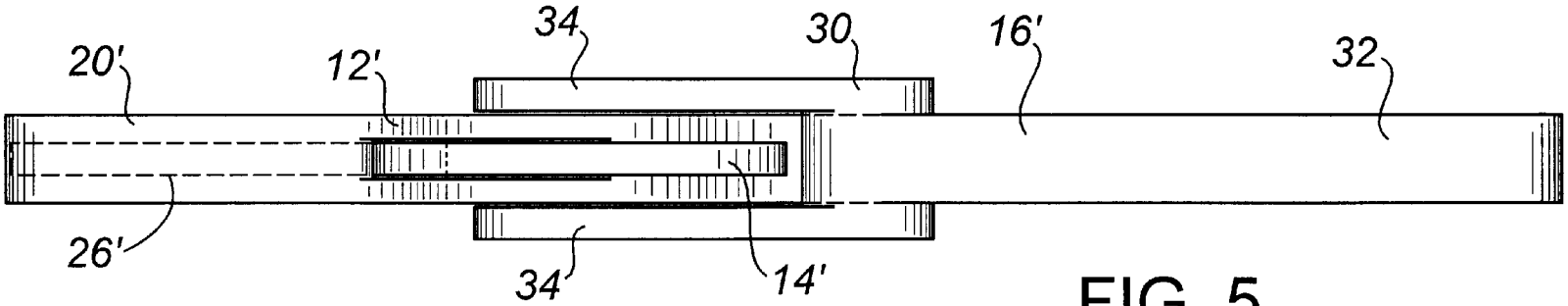
FIG. 5 is a top plan view of the pliers illustrated in FIG. 3.

Referring to FIGS. 3 through 5, an enhanced embodiment is illustrated in which second member 14' is configured with second handle portion 16' acting as a lever to increase the mechanical advantage. In this embodiment, second handle portion 16' is pivotally connected to concave bearing surface portion 28'. Second handle portion 16' has a first end 30 and a second end 32. A first pivotal connection 36 is provided at first end 30 pivotally connecting second handle portion 16' to first member 12'. A second pivotal connection, 38 is provided between first end 30 and second end 32 pivotally connecting second handle portion 16' with concave bearing surface portion 28'. In order to maintain convex bearing surface portion 22' and concave bearing surface portion 28' engaged, first member 12' has a passage 24 adjacent convex bearing surface portion 22' through which second member 14' extends. To provide additional strength, first end 30 of second handle portion 16' is fork shaped having tines 40 which straddle first member 12' and concave bearing surface portion 28' of second member 14'.

The use and operation of the embodiment of pliers 10 illustrated in FIGS. 3 through 5 will now be described. Referring to FIGS. 3 and 4, when first handle portion 18' and second handle portion 16' are squeezed together, second handle portion 16' pivots about first pivotal connection 36 and exerts a leveraged forced at second pivotal connection 38.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A pair of pliers, comprising:

a first member having a first handle portion, a first jaw portion, and a convex bearing surface portion disposed between the first handle portion and the first jaw portion; and a second member having a second handle portion, a second jaw portion and a concave bearing surface portion disposed between the second handle portion and the second jaw portion, the concave bearing surface portion engaging the convex bearing surface portion of the first member to provide a fulcrum point between the first member and the second member, the fulcrum point shifting with relative spacial positioning of the first jaw portion and the second jaw portion, the second handle portion having a first end and a second end, a first pivotal connection being provided at the first end pivotally connecting the second handle portion to the first member, a second pivotal connection being provided between the first end and the second end pivotally connecting the second handle portion with the concave bearing surface portion, whereby the second handle portion functions as a lever.

2. The pliers as defined in claim 1, wherein the first end of the second handle portion is fork shaped having tines which straddle the first member and the concave bearing surface portion of the second member.

3. The pliers as defined in claim 1, wherein the first member has a passage adjacent the convex surface through which the second member extends.

4. The pliers as defined in claim 1, wherein the first jaw portion defines in profile a first half of an outer perimeter of a nut and the second jaw portion defines in profile a second half of an outer perimeter of a nut, such that when the first jaw portion and the second jaw portion clamp together they securely hold a nut.

5. A pair of pliers, comprising:

a first member having a first handle portion, a first jaw portion, and a convex bearing surface portion disposed between the first handle portion and the first jaw portion, the first member having a passage adjacent the convex surface;

a second member having a second handle portion, a second jaw portion and a concave bearing surface portion disposed between the second handle portion and the second jaw portion, the second member extending through which the passage in the first member, the concave bearing surface portion of the second member engaging the convex bearing surface portion of the first member to provide a fulcrum point between the first member and the second member, the fulcrum point shifting with relative spacial positioning of the first jaw portion and the second jaw portion;

the second handle portion having a first end and second end, the first end being fork shaped with tines straddling the first member and the concave bearing surface portion of the second member, a first pivotal connection being provided at the first end pivotally connecting the second handle portion to the first member, a second pivotal connection being provided between the first end and the second end pivotally connecting the second handle portion with the concave bearing surface portion, whereby the second handle portion functions as a lever.

* * * * *